United States Patent [19]

Kawai et al.

[11] 3,991,726

[45] Nov. 16, 1976

[54] ELECTRONICALLY CONTROLLED FUEL INJECTION SYSTEM

[75] Inventors: Mitsuo Kawai, Toyota; Shigehiko Ito, Aichi, both of Japan

[73] Assignees: Nippondenso Co., Ltd., Kariya; Toyota Jidosha Kogyo Kabushiki Kaisha, Toyota, both of Japan

[22] Filed: Jan. 17, 1975

[21] Appl. No.: 542,001

[30] Foreign Application Priority Data

Jan. 26, 1974 Japan ..... 49-11219

[52] U.S. Cl. ..... 123/32 EA; 123/179 L

[51] Int. Cl.[2] ..... F02B 3/00

[58] Field of Search ..... 123/32 EA, 179 L

[56] References Cited

UNITED STATES PATENTS

| | | | |
|---|---|---|---|
| 3,645,240 | 2/1972 | Monpetit | 123/33 EA |
| 3,661,126 | 5/1972 | Baxendale | 123/32 EA |
| 3,680,532 | 8/1972 | Omori | 123/32 EA |
| 3,749,070 | 7/1973 | Oishi | 123/32 EA |
| 3,759,231 | 9/1973 | Endo | 123/32 EA |
| 3,771,502 | 11/1973 | Reddy | 123/32 EA |
| 3,812,830 | 5/1974 | Traisnel | 123/32 EA |
| 3,820,517 | 6/1974 | Nambu | 123/32 EA |
| 3,858,561 | 1/1975 | Aono | 123/32 EA |

*Primary Examiner*—Charles J. Myhre
*Assistant Examiner*—Paul Devinsky
*Attorney, Agent, or Firm*—Cushman, Darby & Cushman

[57] ABSTRACT

There is provided an electronically controlled fuel injection system comprising a temperature fuel enrichment circuit for generating, in accordance with the output signal of an internal combustion engine temperature sensor, an output signal corresponding to a temperature fuel enrichment characteristic to provide the required fuel enrichment for cold operation, and fuel injection means for injecting an increased quantity of fuel in accordance with the output signal of the temperature fuel enrichment circuit. The system is additionally provided with a revolution compensation circuit for generating a revolution signal corresponding to the number of engine revolutions per minute for continuously decreasing the temperature fuel enrichment characteristic of the temperature fuel enrichment circuit in accordance with increase in the number of engine revolutions per minute. In this way, an improved fuel consumption characteristic is ensured during the warmup period and the underfeeding of fuel under the idling operation is eliminated, and moreover the fuel enrichment is smoothly accomplished to suit changes in the driving conditions of the vehicle.

3 Claims, 4 Drawing Figures

ELECTRONICALLY CONTROLLED FUEL INJECTION SYSTEM

BACKGROUND OF THE INVENTION

The present invention relates generally to electronically controlled fuel injection systems of the type in which the quantity of fuel to be fed to an internal combustion engine is computed and injected accordingly, and more particularly the present invention relates to an improvement in the temperature fuel enrichment characteristic of such fuel injection system.

In known fuel injection systems of the above type, the duration of the opening of injection valves (hereinafter simply referred to as an injection time) is determined in accordance with the temperaturedependent variations of the resistance value of a temperature sensor provided in the cooling water path of an internal combustion engine (hereinafter referred to as an engine) to thereby control the fuel injection quantity to suit the required temperature fuel enrichment characteristic of the engine. However, there is a disadvantage in that since the temperature fuel enrichment characteristic required for the engine when it is left under the idling condition differs from that required under the load condition, if the temperature fuel enrichment characteristic is adjusted to ensure smooth idling of the engine, the fuel injection system operated in accordance with this temperature fuel enrichment characteristic tends to feed an excessive quantity of fuel during the driving period prior to the completion of warming up the engine, thus increasing the fuel consumption rate.

Another disadvantage is that if the temperature fuel enrichment characteristic is established to suit the fuel requirements of the engine under the load conditions, the engine tends to stall when it is returned to the idling speed.

While most common types of fuel injection systems which have heretofore been proposed to overcome the foregoing difficulty include those in which the temperature fuel enrichment characteristics are changed when the pressure in the engine air intake passage exceeds a predetermined value (i.e., when the load increases) or when the vehicle speed reaches a predetermined value as well as others in which the characteristics are changed in accordance with the openings of the throttle valve, there are disadvantages that the driveability is impaired by a rapid change in the fuel injection quantity resulting from the stepwise change of the characteristics and that the provision of an additional pressure switch, vehicle speed discriminator, throttle switch or the like is required.

SUMMARY OF THE INVENTION

With a view to overcoming the foregoing difficulty, it is the object of the present invention to provide an electronically controlled fuel injection system in which the temperature fuel enrichment characteristic that is dependent on the engine temperature is continuously varied in accordance with the number of revolutions per minute of the engine, thereby suitably adjusting the fuel enrichment under both the idling and load conditions with a simple arrangement and without impairing the drive-ability.

DESCRIPTION OF THE PREFERRED EMBODIMENT

A preferred embodiment of the present invention will now be described in detail with reference to the accompanying drawings.

Figure 1:
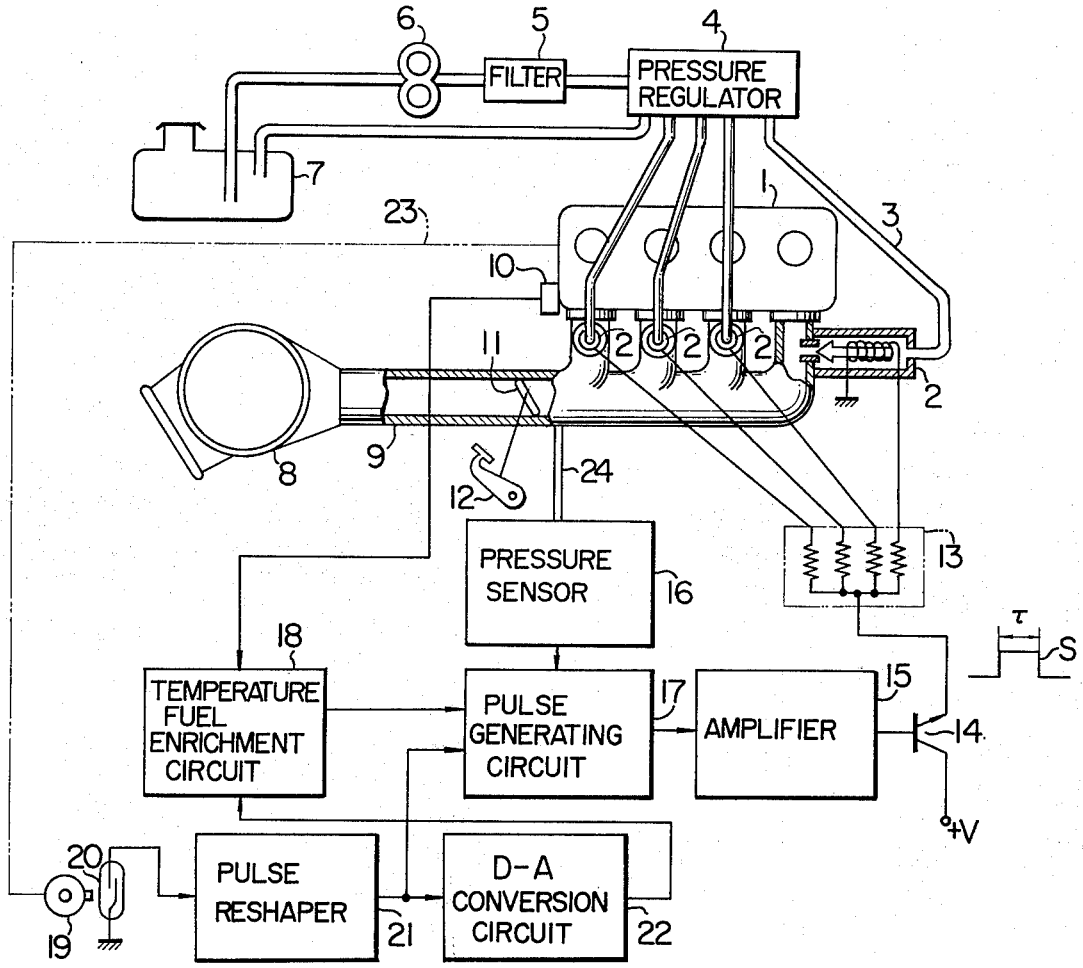
FIG. 1 is a block diagram showing the general construction of an embodiment of an electronically controlled fuel injection system according to the present invention.

In the embodiment shown in FIG. 1, the electronically controlled fuel injection system according to this invention is used in the operation of a fourcycle gasoline engine. In FIG. 1, numeral 1 designates an engine, 2 electromagnetic valves mounted on the respective inlet pipes of the engine cylinders and constituting fuel injection means. The fuel contained in a fuel tank 7 is supplied under pressure to a pressure regulator 4 and fuel pipes 3 and to the electromagnetic valves 2 by an electrically operated pressure fuel pump 6 through a filter 5. The pressure regulator 4 is designed so that by the action of its pressure control valve the fuel pressure in the fuel pipes 3 is maintained at a predetermined value, e.g., a gage pressure of 2 kg/cm$^2$, and the excess fuel is circulated through a return line back into the fuel tank 7. The air drawn into the engine 1 is cleaned by a filter 8 and the air is distributed into the respective cylinders through a suction duct 9. A throttle valve 11 is provided in the middle part of the suction duct 9 and it is mechanically connected to an accelerator pedal 12 so that the throttle valve 11 is opened and closed in accordance with the movement of the accelerator pedal 12. Numeral 10 designates a temperature sensor for detecting the engine temperature to obtain a temperature fuel enrichment characteristic which is dependent on the engine temperatures. Each of the electromagnetic valves 2 is energized through its associated protective resistor 13 by the conduction of a power transistor 14, so that the electromagnetic valve 2 is opened and the fuel under pressure in the fuel pipe 3 is injected into the engine inlet pipe. The power transistor 14 is rendered conductive for the duration of an injection time $\tau$ required by the engine in accordance with the output pulse or injection signal of computing means that will be described hereinafter in detail.

An electronic control circuit constituting the computing means in triggered twice for every rotation of the engine cam shaft by means of an oscillator connected to a cam or crankshaft 23 of the engine 1, so that each time the control circuit is triggered, the power transistor 14 supplies an output pulse S of a time width $\tau$ to the electromagnetic valves 2. The time width $\tau$ of the output pulses S controls the injection time of the electromagnetic valves 2 and hence the quantity of fuel fed to the engine 1 is controlled. Numeral 16 designates a pressure sensor constituting detecting means for detecting the vacuum in the suction duct 9 of the engine 1 and it is connected by a pipe 24 to the suction duct 9 downstream of the throttle valve 11. The vacuum in the suction duct 9 represents the amount of air drawn which corresponds to the operating condition of the engine, and therefore the output signal of the pressure sensor 16 is applied to a pulse generating circuit 17 which constitutes the computing means for generating the output pulses S. On the other hand, the temperature of the cooling water in the engine 1 is detected by the temperature sensor 10 and its output signal is converted by a temperature fuel enrichment circuit 18 to suit the required temperature fuel enrichment characteristic of the engine 1 and applied to the pulse generating circuit 17. The number of revolutions per minute of the engine 1 is detected by means of a revolution detector comprising for example a reed switch 20 and a magnet 19 which is rotated by the crankshaft 23, and its output signal is reshaped by a pulse reshaper 21 and it triggers the pulse generating circuit 17. Consequently, the pulse generating circuit 17 generates an output pulse having the time width $\tau$ determined by the signals from the pressure sensor 16 and the temperature fuel enrichment circuit 18 and this output pulse is applied to an amplifier 15 whose output renders the power transistor 14 conductive. Numeral 22 designates a D-A conversion circuit constituting a revolution compensation circuit which converts the reshaped output pulse of the pulse reshaper 21 into a DC signal proportional to the engine revolutions and applies this DC signal to the temperature fuel enrichment circuit 18 to thereby continuously vary its temperature fuel enrichment characteristic.

Figure 2:
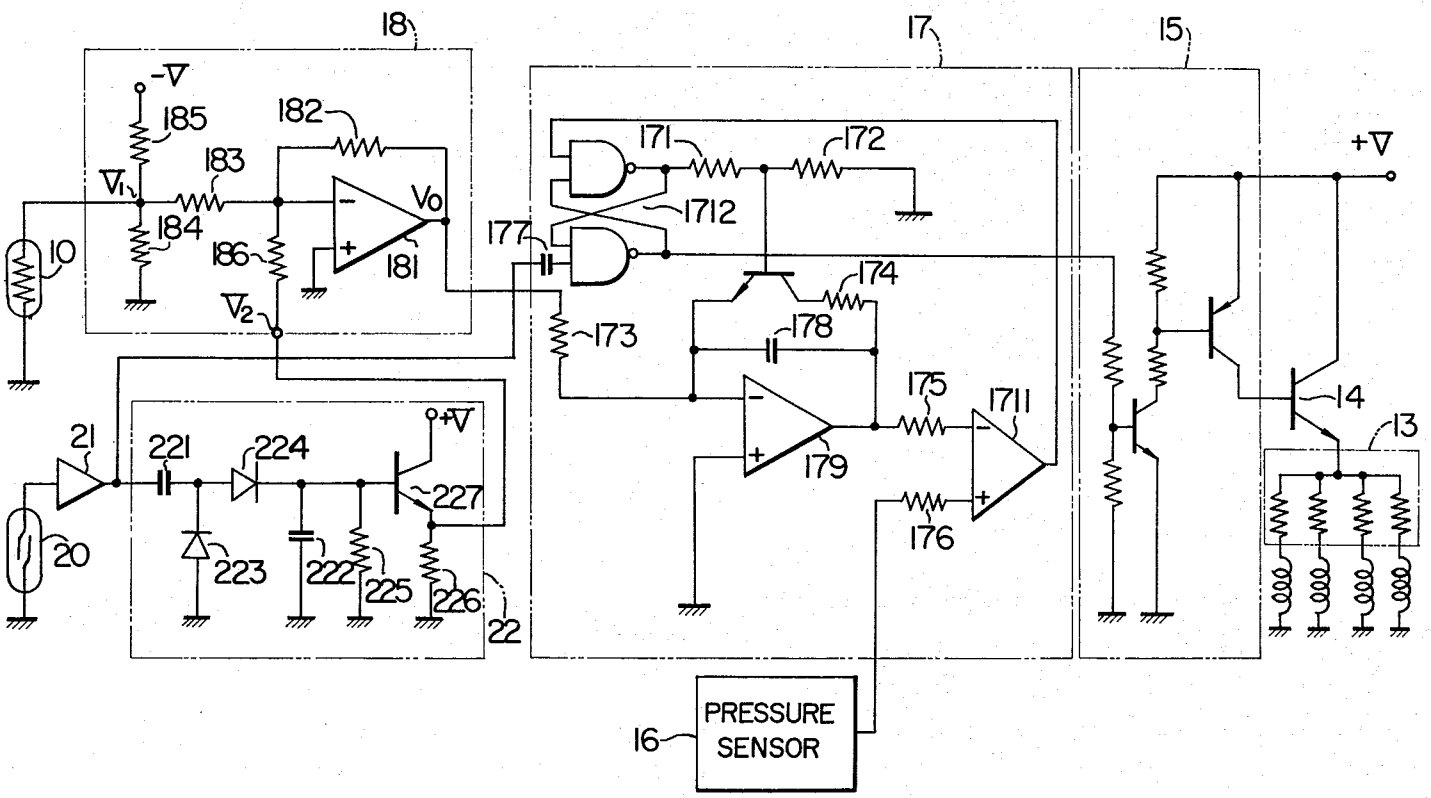
FIG. 2 is a wiring diagram showing a detailed circuit diagram of the principal part of the embodiment shown in FIG. 2

Referring to the wiring diagram of FIG. 2, the pulse generating 17, the temperature fuel enrichment circuit 18 and the D-A conversion circuit 22 constituting the revolution compensation circuit will be described in greater detail. The pulse generating circuit 17 comprises resistors 171, 172, 173, 174, 175 and 176, capacitors 177 and 178, an operational amplifier 179, a comparator 1711 and a flip-flop 1712. The voltage applied to the inverting input terminal of the operational amplifier 179 is integrated and it is then compared with the voltage applied from the pressure sensor 16 to the noninverting input terminal of the comparator 1711 to reset the flip-flop 1712 and thereby to control the injection time of the electromagnetic valves 2. In this case, the more negative the voltage applied to the inverting input terminal of the operational amplifier 179 is, the shorter the injection time becomes.

In the temperature fuel enrichment circuit 18, numeral 181 designates an operation amplifier of which noninverting input terminal is grounded, and the output signal $V_1$ of the engine cooling water temperature sensor 10 and the revolution signal $V_2$ of the D-A conversion circuit 22 are applied through the respective input resistors 183 and 186 to the inverting input terminal thereof. Numeral 182 designates a feedback resistor for adjusting the output signal $V_0$ of the operational amplifier 181 to the predetermined temperature fuel enrichment characteristic. The temperature sensor 10 may be a resistance element such as a thermistor whose resistance value changes with temperature, so that the potential of the output signal $V_1$ generated at the middle point of a bridge circuit comprising resistors 184 and 185 is varied in accordance with the variation in the resistance value of the temperature sensor 10. The D-A conversion circuit 22 comprises capacitors 221 and 222, diodes 223 and 224, resistors 225 and 226 and a transistor 227, and the value of the revolution signal $V_2$ generated across the resistor 226 increases as the engine speed increases.

Thus, by arranging so that when, for example, the output voltage $V_0$ of the temperature fuel enrichment circuit 18 becomes more negative the time width $\tau$ of the output pulse of the pulse generating circuit 17 decreases, when the cooling water temperature representing the engine temperature decreases so that the resistance value of the temperature sensor 10 increases and the potential of its output signal $V_1$ becomes more negative thus increasing the output voltage $V_0$ toward the positive direction, the time width $\tau$ of the output pulse of the pulse generating circuit 17 is increased and the amount of enrichment fuel is also increased. Further, by designing the D-A conversion circuit 22 so that the output revolution signal $V_2$ of the D-A conversion circuit 22 increases with increase in the engine revolutions, essentially the revolution signal $V_2$ applied to the inverting input terminal of the operational amplifier 181 increases the output signal $V_0$ toward the negative direction, with the result that the time width $\tau$ of the output pulse is decreased and the amount of enrichment fuel is decreased.

Figure 3:
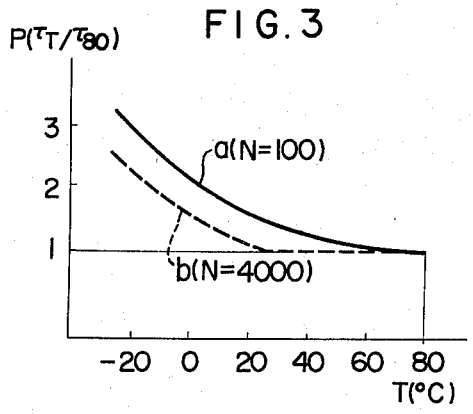
FIG. 3 is a temperature versus fuel enrichment ratio characteristic diagram.
Figure 4:
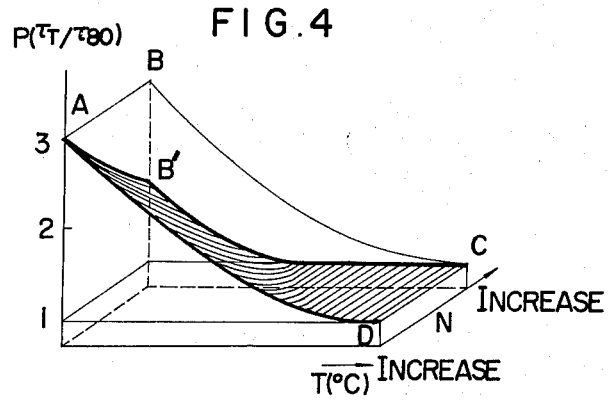
FIG. 4 is a characteristic diagram showing a three-dimensional representation of the characteristics shown in FIG. 3.

The above-described temperature fuel enrichment characteristic will be described further with reference to the characteristic diagrams shown in FIGS. 3 and 4. In FIG. 3, the abscissa represents the engine cooling water temperature T and the ordinate represents the enrichment ratio P with the time width $\tau$ of the output pulse at 80° C being assumed as 1. The time width $\tau$ of the output pulse at the respective temperatures is such that if N represents for example the engine revolutions, the characteristic curve shown by the solid line *a* results when N = 800 rpm, whereas the characteristic curve shown by the broken line *b* is obtained when N = 4,000 rpm, thus showing that the enrichment ratio continuously decreases in the low temperature range with increase in the revolutions N. Referring to FIG. 4 showing the relationship among the cooling water temperature T, the engine revolutions N and the enrichment ratio P in a three dimensional manner, in the case of the conventional systems the enrichment ratio P varies in the plane as shown by the characteristic curved surface ABCD and no adjustment is effected in accordance with the revolutions N, whereas in the case of the present invention the enrichment ratio P varies in the plane shown by the characteristic curved surface AB'CD. The effect of this is that the enrichment ratio P is continuously varied in accordance with the engine revolutions N. By controlling the amount of increase in the fuel injection quantity in accordance with this temperature fuel enrichment characteristic, it is possible to produce highly satisfactory results in improving the fuel consumption characteristic during the warm-up period, and it is also possible to prevent any engine irregularities when the engine is returned to the idling operation.

While, in the embodiment of the present invention described above, the electromagnetic valves 2 of the respective cylinders are actuated simultaneously to effect the simultaneous injection of fuel into all the cylinders of the engine, it is of course possible to apply the present invention to any systems of separate injection type in which each of the electromagnetic valves on the engine cylinders is actuated in accordance with its own suitable timing.

Futhermore, while, in the above-described embodiment, the amount of fuel fed to the engine is controlled in accordance with the output pulse width of the pulse generating circuit 17, the fuel injection quantity may for example be controlled according to the number of pulses or any other means, and moreover the present invention is not limited to the detecting means which detects the vacuum in the suction duct as was the case with the illustrated embodiment and the amount of air drawn may be measured and detected instead.

Still further, while, in the embodiment described above, the output signal of the temperature fuel enrichment circuit which corresponds to the required temperature fuel enrichment characteristic is applied to the computing means to accomplish the required fuel enrichment, the output pulse which corresponds to the temperature fuel enrichment characteristic may be added to the output pulse of the computing means or alternately the quantity of fuel calculated in accordance with the temperature fuel enrichment characteristic may be injected into the engine cylinders by means of separate injection means.

It will thus be seen from the foregoing description that in accordance with the present invention, an electronically controlled fuel injection system wherein a temperature fuel enrichment circuit generates, in accordance with the output signal of a temperature sensor corresponding to the engine temperature, an output signal corresponding to a temperature fuel enrichment characteristic for accomplishing the required fuel enrichment in the low temperature range of the engine and the output signal is used to actuate fuel injection means to inject an increased quantity of fuel, is further provided with a revolution compensation circuit for generating a revolution signal corresponding to the number of engine revolutions per minute and continuously decreasing the temperature fuel enrichment characteristic in accordance with increase in the engine revolutions per minute. There is thus a great advantage that by virtue of a simple construction requiring only the addition of such a revolution compensation circuit, it is possible to ensure an improved fuel consumption characteristic during the warm-up period and prevent the underfeeding of fuel during the idling operation, and it is also possible to ensure a smooth fuel enrichment to suit the changes in the operating conditions of the engine.

What is claimed is:

1. An electronically controlled fuel injection system comprising a temperature sensor for detecting the temperature of an internal combustion engine, a temperature fuel enrichment circuit responsive to the output signal of said temperature sensor for generating an output signal corresponding to a temperature fuel enrichment characteristic for providing the required fuel enrichment in the low temperature range of said engine, and fuel injection means responsive to the output signal of said temperature fuel enrichment circuit for injecting an increased amount of fuel, wherein the improvement comprises a revolution compensation circuit connected to said temperature fuel enrichment circuit for generating an output signal corresponding to the number of revolutions of said engine thereby to continuously decrease the temperature fuel enrichment characteristic in accordance with increase in the number of revolutions of said engine, whereby said increased amount of fuel injected depends on both the engine temperature and the revolutions of the engine, with the increased amount of fuel decreased as the engine temperature and the revolutions of the engine respectively increase.

2. An electronically controlled fuel injection system according to claim 1, wherein said temperature fuel enrichment circuit comprises a pulse generating circuit for generating a pulse signal having a time width which is determined in accordance with the operating conditions of the engine, and wherein said fuel injection means comprises and fuel injection valve provided in a fuel path of a fixed fuel pressure, said fuel injection valve being actuated by said pulse signal.

3. An electronically controlled fuel injection system according to claim 1, wherein said revolution compensation circuit comprises a revolution detector for generating pulse signals, the number of said pulse signals being proportional to the number of revolutions of the engine, and a D-A conversion circuit connected to said revolution detector for generating a voltage signal corresponding to said number of pulse signals.

* * * * *